US005539950A

United States Patent [19]

Zar et al.

[11] Patent Number: 5,539,950

[45] Date of Patent: * Jul. 30, 1996

[54] PROTECTIVE HOUSING FOR ROLLER COVER

[76] Inventors: Randy Zar, 418 Coates Dr., Aptos, Calif. 95003; James Streetmaker, 29503 Baycrest Dr., Rancho Palos Verdes, Calif. 90274

[ * ] Notice: The portion of the term of this patent subsequent to Oct. 30, 2014, has been disclaimed.

[21] Appl. No.: 309,884

[22] Filed: Feb. 14, 1989

Related U.S. Application Data

[63] Continuation-in-part of Ser. No. 197,856, May 24, 1988.

[51] Int. Cl.[6] ..... B08B 17/04

[52] U.S. Cl. ..... 15/248.2; 134/182; 206/349; 220/339

[58] Field of Search ..... 15/248A; 206/349, 206/361; 220/4 E, 339, 4 B; 68/213; 401/131, 197; 134/182

[56] References Cited

U.S. PATENT DOCUMENTS

| | | | |
|---|---|---|---|
| 1,869,753 | 8/1932 | Kamm | 206/361 |
| 2,770,386 | 11/1956 | Mitchell et al. | 220/4 B |
| 2,798,631 | 7/1957 | Engel | 220/4 B |
| 3,149,747 | 9/1964 | Burgess | 220/4 B |
| 3,511,433 | 5/1970 | Andrews et al. | 220/4 E |
| 3,712,748 | 1/1973 | Wilmans | 401/197 |
| 3,828,389 | 8/1974 | Heisler | 15/257.06 |
| 4,077,515 | 3/1978 | Snoberg | 220/4 E |
| 4,445,250 | 5/1984 | Seidl | 220/4 E |
| 4,547,926 | 10/1985 | Kern | 220/4 B X |
| 4,691,838 | 9/1987 | Graham et al. | 15/257.06 |
| 4,700,830 | 10/1987 | O'Brien | 401/197 X |
| 4,802,576 | 2/1989 | Kern | 15/257.06 |

*Primary Examiner*—Frankie L. Stinson
*Attorney, Agent, or Firm*—John E. Halamka

[57] ABSTRACT

A protective housing for the purpose of inhibiting the drying of materials in contact with the roller cover installed on a roller applicator. Applicator shaft seals and perimeter seals around protective housing inhibit the escape of fluid materials from or the intrusion of materials onto the roller cover. A transparent housing enables the user to visually identify the type of covering materials which are in contact with the roller cover.

12 Claims, 3 Drawing Sheets

PROTECTIVE HOUSING FOR ROLLER COVER

BACKGROUND OF THE INVENTION

1. Field of the Invention

This invention relates to the construction art and, more particularly, is a Continuation-In-Part of application Ser. No. 07/197,856, filed May 24, 1988, by one of the same inventors and to an improved container for protecting and preserving a roller applicator and roller cover which was used to apply coatings.

2. Description of the Prior Art

Since the invention of the roller applicator, the users of this tool have had problems with roller covers drying out after short periods of time such as during lunch brake, or just setting the roller down while they do something else. This is especially true with todays fast drying paints, glues and many other materials which are applied with the roller applicator. Even when the materials don't dry fast, at the end of a days work the user must clean the roller cover or just throw it away. Disposal of the used roller is the current prevalent practice because it takes more time and makes more of a mess then the roller cover itself is worth.

U.S. Pat. No. 1,869,753 describes various types of brush preserving cases which may be utilized to house paint brushes containing paint. The cases rely upon a compressible strip clamped into one edge with the opposing wall overlapping to compress the strip and seal the container. The teaching of this patent is only applicable to wedge shaped devices. The utilization of overlapping edges according to the teachings of this patent to surround a cylinder shaped object would create an interference fit which would not result in the desired air tight container. Further, the utilization of a compressible strip along the working edge of a cylinder shaped container to hold a roller type applicator full of coating material would cause the compressible strip to become contaminated with coating material upon insertion of the roller; the compressible strip would loose its compressibility or resiliency and thus defeat the desired air tight inclosure.

Other United States Patents such as U.S. Pat. No. 4,667,361 have shown devices to clean and remove the roller cover from the roller applicator. However, only a portion of the coating material is removed from the roller cover. If left unattended, the remaining coating material will dry and render the roller cover unusable. The device does not teach surrounding the roller cover. In fact, the device teaches the use of a tab (19) to prevent the close abutment of the long edges (30).

Thus, there has long been a need for a protective housing which could be easily positioned over the roller cover and roller applicator combination to form an air tight container to prevent the coating material absorbed by the roller cover from drying out or becoming contaminated. This containment reduces the toxic levels in the environment by sealing in the fumes of the coating and solvents applied by roller method.

Further, it is also desired that the protective housing device provide convenient insertion and removal of the roller cover and applicator from the device without contamination of the seal. It is also desired that the device be transparent to allow easy identification of the material absorbed by the roller cover.

SUMMARY OF THE INVENTION

Accordingly, it is an object of the present invention to provide an improved material applicator cover to protect the roller cover as mounted on a roller applicator from becoming unusable due to the drying process of materials absorbed by the roller cover or materials which come into contact with the roller cover.

It is another object of the present invention to provide a protective housing which may be used without removing the roller cover from the roller applicator.

It is another object of the present invention to reduce the frequency of cleaning the roller cover between uses and extending the useful life of the roller cover.

It is yet another object of the present invention to prevent the escape of the coating materials from the cover as applied to the roller cover mounted on the roller applicator. This will stop the fluid materials from coming in contact with other rollers, applicators, tools, etc. during storage and transportation.

It is yet another object of the present invention to allow the user to easily identify what material is absorbed by the roller cover.

It is yet another object of the present invention to provide a protective housing which is portable, easily installed and removed so that the roller cover may be set aside without fouling the environment or allowing foreign particles to become stuck to and foul the roller cover.

The above and other object of the present invenit are achieved, according to a preferred embodiment thereof, by providing a hinged, transparent, body, unitarily fabricated of a lightweight ridged material. Generally located within the peripheral edge of the body, there is an interlocking perimeter seal means. The peripheral edge of the body may be generally rectangular.

In some embodiments of the present invention, it may be desired to provide a plurality of interlocking buttons separate from the perimeter seal means to assist in maintaining the body in a closed configuration. In addition, tabs may be present in some embodiments to allow ease of opening the body.

An aperture is required through the peripheral edge to allow the positioning of the device around the roller applicator shaft upon which is mounted the roller cover. The aperture may be located along one of the short sides of the rectangular peripheral edge. The aperture is small and curved to conform to the shape of the shaft in order to seal the liquid coating material and fumes within the body.

Certain embodiments utilize a wide perimeter around the equator of the body. The shaft of the roller applicator may be fabricated with a right angle near the edge of the roller cover. Therefore, the aperture is configured to accommodate the exit of the shaft along the longer edge of the rectangular perimeter seal. At the exit point, the peripheral seal is shaped to tightly enclose the round shaft to prevent the escape of coating material along the shaft.

The body is shaped to encapsulate the cylindrical form of the roller cover. The peripheral seal is at the equator of the device so that excess coating material will flow to one of the poles when the device is stored in a flat configuration.

BRIEF DESCRIPTION OF THE DRAWING

The above and other embodiments of the present invention may be more fully understood from the following detailed description, taken together with the accompanying drawing, wherein similar reference characters refer to similar elements throughout, and in which.

DESCRIPTION OF A PREFERRED EMBODIMENT

Figure 1:
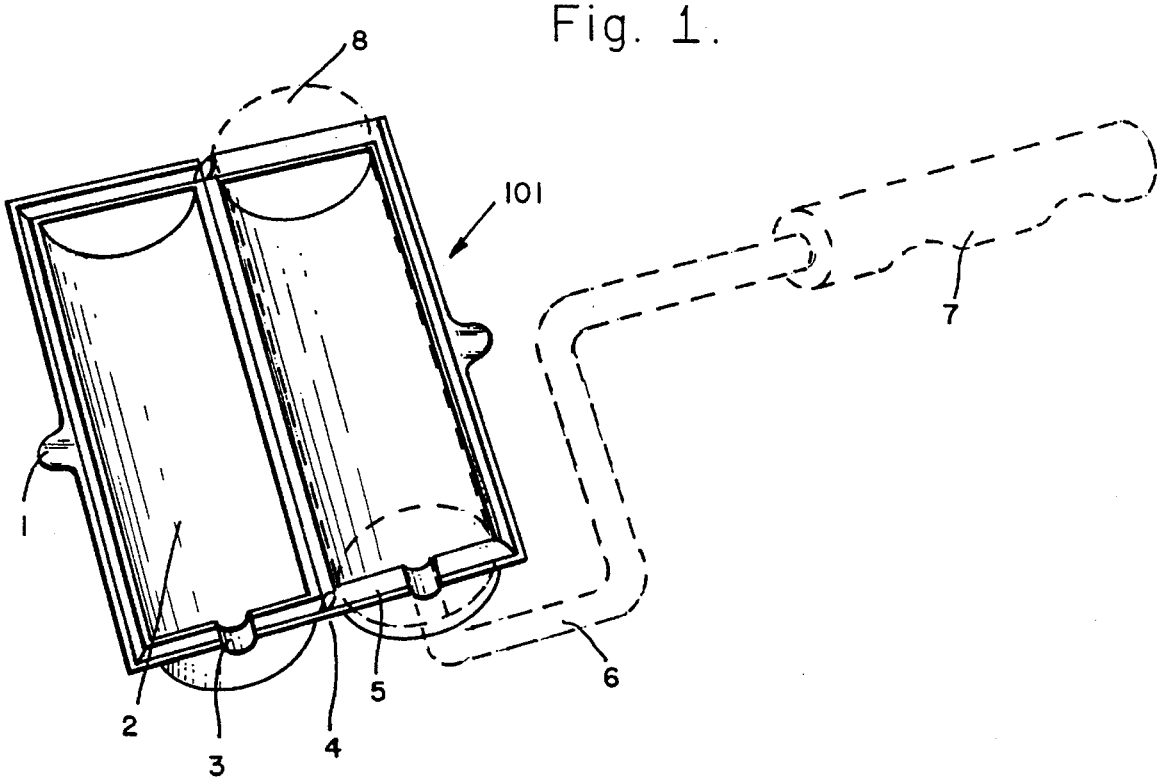
FIG. 1 is a perspective view of the present invention with one section applied to the roller cover mounted on a roller applicator.

Referring now to the drawing, there is illustrated in FIG. 1 a perspective view of the protective housing 101 according to the principles of the present invention with a roller cover 8 mounted on a roller applicator 7 inserted in one of the half-cylinder shaped portions of the protective housing 101. The protective housing 101 may be formed as a unitary device of thin, transparent plastic sheet material.

The body 2 is generally comprised of one half of a hollow cylinder 12 with ends 13 having a peripheral edge 10 at right angles to the surface of the cylinder 12 and ends 13 hingedly attached by hinge 4 to a second one half of a hollow cylinder 12 with ends 13 having a peripheral edge 10 at right angles to the surface of the cylinder 12 and ends 13. The opposing half cylinders 12 being hingedly attached in alignment to generally appear as a clam shell which encompasses a roller cover 8.

Figure 2:
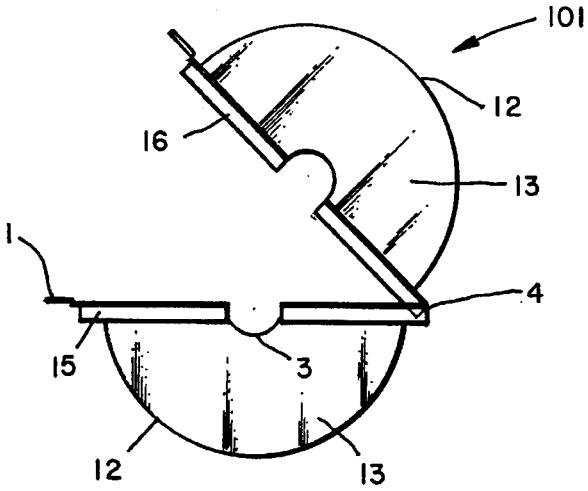
FIG. 2 is a view of the end of the present invention containing the aperture for the roller applicator shaft.

A concave perimeter seal means 15 is formed in the peripheral edge of one of the hollow cylinders 12. A convex perimeter seal means 16 is formed in the peripheral edges of the other hollow cylinder 12 and positioned to be insertably engagable with the concave perimeter seal means 15. The perimeter seals 15 and 16 are generally square in cross section. The perimeter seal means is more clearly shown in FIG. 2.

The channel seal 3 is placed at one end 13 of the opposing half cylinders 12 and is formed as a continuing part of both the concave perimeter seal 15 and the convex perimeter seal 16 so that the channel seal 3 surrounds the roller applicator shaft 6.

Figure 3:
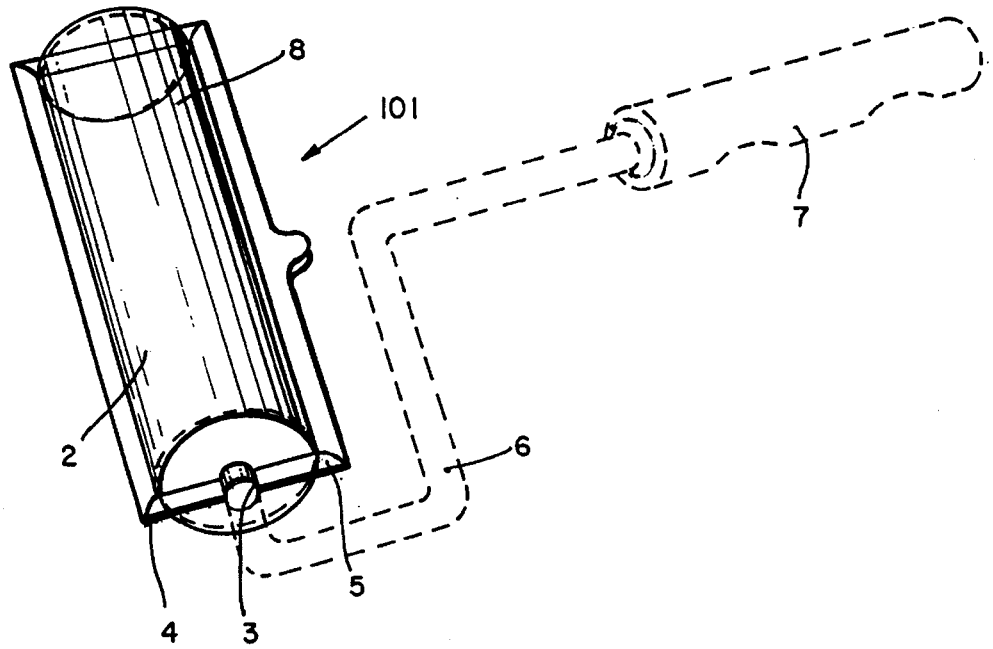
FIG. 3 is another embodiment of the present invention.

Pull tabs 1 extend from the peripheral edges opposite the hinged edges to provide a handle for the user to open the device after the convex peripheral seal 16 is engaged with the concave peripheral seal 15 as shown in FIG. 3. The pull tabs 1 may be offset to allow ease of separation.

The pull tabs 1 are used to provide the user with easy access to open the device and to prevent deforming of the peripheral seals 15 and 16. The convex peripheral seal 16 is to engage the concave peripheral seal 15 with a tight fit to be air tight yet not too tight so as to deform the seal. However, the seal must not be loose enough to pop open when the roller applicator is moved.

The hinge 4 is shown as a joint between one long edge of the rectangular peripheral seals 15 and 16.

Some roller applicators are designed with a shaft which has a right angle bend close to the edge of the installed roller cover. It the bend is too close, the protective housing 101 will not be able to close around the shaft.

Figure 4:
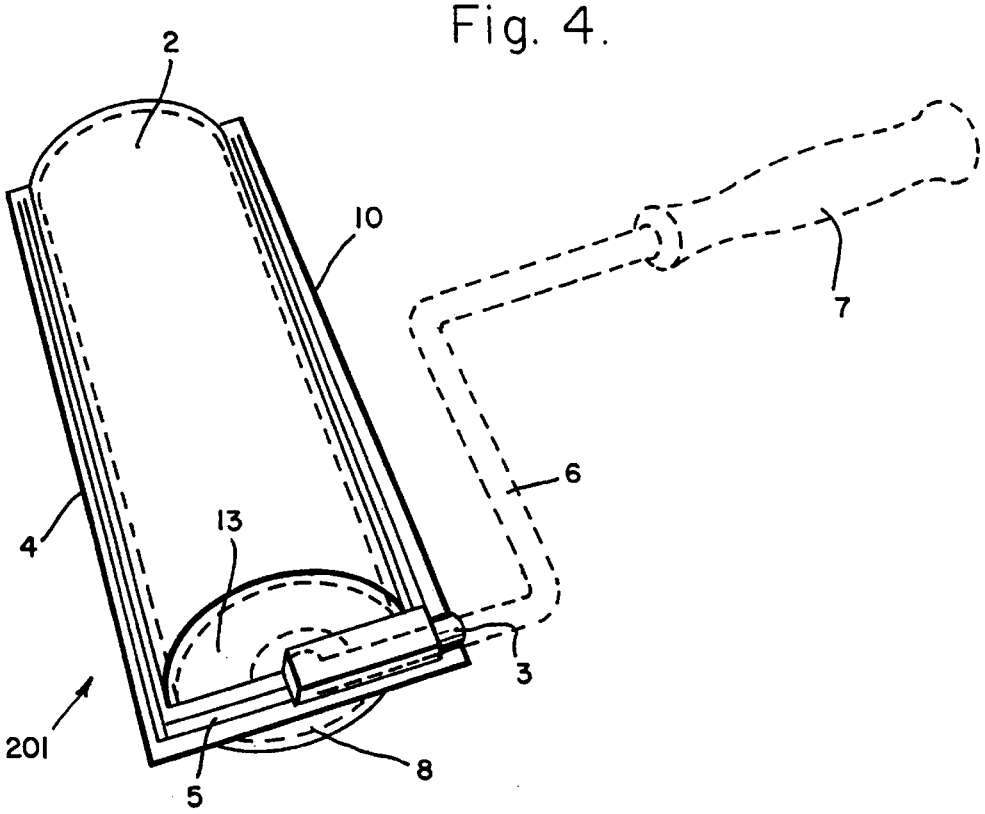
FIG. 4 is a perspective view of the present invention enclosing a roller cover mounted on a roller applicator.

FIG. 4 shows yet another embodiment of a protective housing device 201 constructed according to the teachings of this invention which may be used with short shaft roller applicators.

The operation of the protective housing device 201 is similar to the protective housing 101 described above. The channel seal 3 of the device 201 is extended at a right angle along the perimeter seal means 5.

Figure 5:
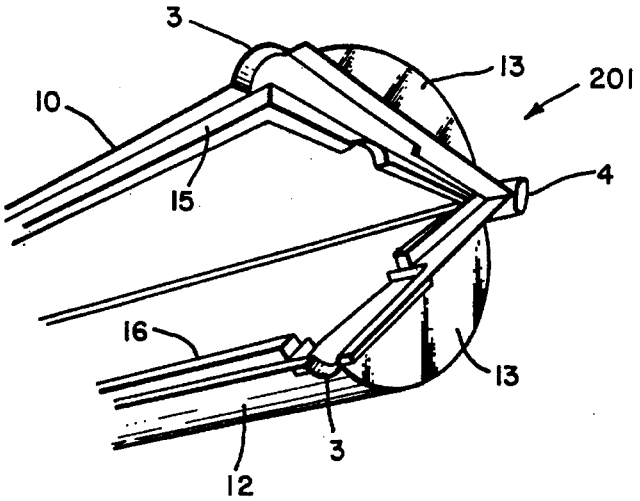
FIG. 5 is a perspective view of the present invention open to show the detail of the end containing the extended channel.

FIG. 5 shows the detail of the extended channel seal 3.

Figure 6:
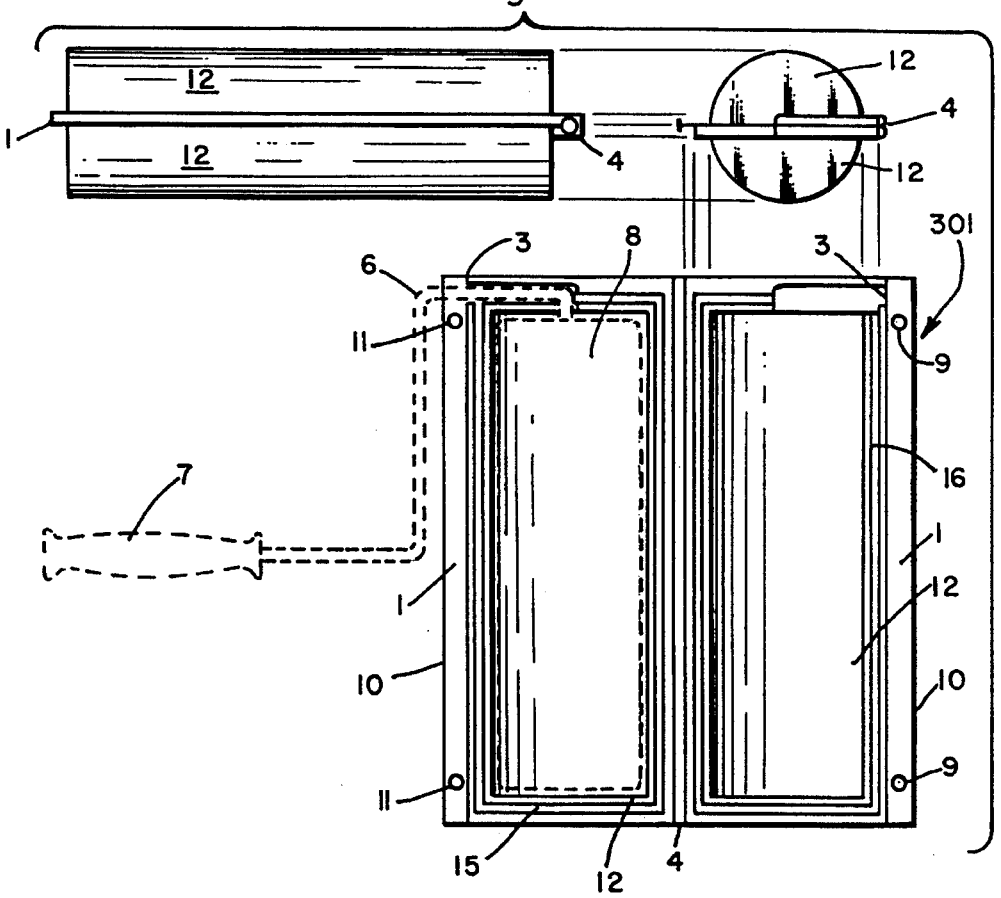
FIG. 6 is a view of yet another embodiment of the present invention.

FIG. 6 shows yet another embodiment of the protective housing device 301 constructed according to the teaching of this invention. The operation of the protective cover 301 is similar to the protective housing 201. The long peripheral edge 10 opposite the hinge 4 is extended to form a pull tab arrangement 1. Interlocking buttons 11 are formed in one of the extended peripheral edges 10 as a raised hollow mound. Raised buttons 9 are formed within the other extended peripheral edge 10 and positioned to be removably, insertably engagable with the interlocking buttons 11. When the protective housing device 301 is closed around the roller cover 8 mounted on the roller applicator 7 and the raised buttons 9 are engaged with the interlocking buttons 11, the closure of the perimeter seal means 5 is enhanced. The buttons provide a secondary closure means.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. A protective housing adapted to enclose a roller cover mounted on a roller applicator having a shaft comprising, in combination:

a unitarily fabricated body having;

two half, hollow cylinder portions with ends, a peripheral edge extending at a right angle from the walls of said cylinder portions and from said ends, a hinge connecting the segment of said peripheral edge adjacent one side of each of said cylinder portions whereby the concave surface of said cylinder portions are in opposing alignment, a perimeter seal means formed in said peripheral edge, and a channel seal for said shaft, whereby, for the condition of said cylinder portions being hingedly open, the user may removably insert said roller cover with said roller applicator shaft within said channel seal into said protective housing and enclose said roller cover with said protective housing by engaging said perimeter seal means.

2. A protective housing defined in claim 1 wherein:

said body is fabricated of transparent sheet material.

3. A protective housing defined in claim 1 further comprising:

a tab mounted on a portion of one of said peripheral edges opposite said hinge providing a handle for the user to disengage said perimeter seal means.

4. A protective housing defined in claim 1 further comprising:

a plurality of tabs mounted on a portion of said peripheral edges opposite said hinge with at least the first tab offset at least the second tab providing opposing handles for the user to disengage said perimeter seal means.

5. A protective housing defined in claim 1 wherein:

the portion of each of said peripheral edges opposite said hinge are extended, a plurality of interlocking buttons are mounted in one said extended peripheral edge with opposing raised buttons insertably removable from said interlocking buttons mounted in the other said extended peripheral edge.

6. A protective housing defined in claim 1 wherein:

said perimeter seal means in one of said peripheral edges defines a concave surface and said perimeter seal means in the other of said peripheral edges defines a convex surface insertably removably from said concave surface.

7. A protective housing defined in claim 6 wherein:

said concave surface and said convex surface define substantially a square cross section.

8. A protective housing defined in claim 1 wherein:

said channel seal defines a right angle channel extending from said end surface to said peripheral edge opposite said hinge.

9. A protective housing adapted to enclose a roller cover mounted on a roller applicator having a shaft comprising, in combination:

a body unitarily fabricated of transparent sheet material having;

two half, hollow cylinder portions with ends, a peripheral edge extending at a right angle from the walls of said cylinder portions and from said ends, a hinge connecting the segment of said peripheral edge adjacent one side of each of said cylinder portions whereby the concave surface of said cylinder portions are in opposing alignment, a perimeter seal means formed in said peripheral edge, said perimeter seal means in one of said peripheral edges defining a concave surface and said perimeter seal means in the other of said peripheral edges defining a convex surface insertably removably from said concave surface, a channel seal for said shaft defining a right angle channel extending from said end surface to said peripheral edge opposite said hinge, and a tab mounted on a portion of one of said peripheral edges opposite said hinge providing a handle for the user to disengage said perimeter seal means, whereby, for the condition of said cylinder portions being hingedly open, the user may removably insert said roller cover with said roller applicator shaft within said channel seal into said protective housing and enclose said roller cover with said protective housing by engaging said perimeter seal means.

10. A protective housing adapted to enclose a roller cover mounted on a roller applicator having a shaft comprising, in combination:

a body unitarily fabricated of transparent sheet material having;

two half, hollow cylinder portions with ends, a peripheral edge extending at a right angle from the walls of said cylinder portions and from said ends, a hinge connecting the segment of said peripheral edge adjacent one side of each of said cylinder portions whereby the concave surface of said cylinder portions are in opposing alignment, a perimeter seal means formed in said peripheral edge, said perimeter seal means in one of said peripheral edges defining a concave surface and said perimeter seal means in the other of said peripheral edges defining a convex surface insertably removably from said concave surface, a channel seal for said shaft defining a right angle channel extending from said end surface to said peripheral edge opposite said hinge, and a plurality of tabs mounted on a portion of said peripheral edges opposite said hinge with at least the first tab offset at least the second tab providing opposing handles for the user to disengage said perimeter seal means, whereby, for the condition of said cylinder portions being hingedly open, the user may removably insert said roller cover with said roller applicator shaft within said channel seal into said protective housing and enclose said roller cover with said protective housing by engaging said perimeter seal means.

11. A protective housing adapted to enclose a roller cover mounted on a roller applicator having a shaft comprising, in combination:

a body unitarily fabricated of transparent sheet material having;

two half, hollow cylinder portions with ends, a peripheral edge extending at a right angle from the walls of said cylinder portions and from said ends, a hinge connecting the segment of said peripheral edge adjacent one side of each of said cylinder portions whereby the concave surface of said cylinder portions are in opposing alignment, a perimeter seal means formed in said peripheral edge, said perimeter seal means in one of said peripheral edges defining a concave surface and said perimeter seal means in the other of said peripheral edges defining a convex surface insertably removably from said concave surface, a plurality of interlocking buttons mounted in one said extended peripheral edge opposite said hinge, opposing raised buttons insertably removable from said interlocking buttons mounted in the other said extended peripheral edge opposite said hinge, a channel seal for said shaft defining a right angle channel extending from said end surface to said peripheral edge opposite said hinge, and a tab mounted on a portion of one of said peripheral edges opposite said hinge providing a handle for the user to disengage said perimeter seal means, whereby, for the condition of said cylinder portions being hingedly open, the user may removably insert said roller cover with said roller applicator shaft within said channel seal into said protective housing and enclose said roller cover with said protective housing by engaging said perimeter seal means.

12. A protective housing adapted to enclose a roller cover mounted on a roller applicator having a shaft comprising, in combination:

a body unitarily fabricated of transparent sheet material having;

two half, hollow cylinder portions with ends, a peripheral edge extending at a right angle from the walls of said cylinder portions and from said ends, a hinge connecting the segment of said peripheral edge adjacent one side of each of said cylinder portions whereby the concave surface of said cylinder portions are in opposing alignment, a perimeter seal means formed in said peripheral edge, said perimeter seal means in one of said peripheral edges defining a concave surface and said perimeter seal means in the other of said peripheral edges defining a convex surface insertably removably from said concave surface, a plurality of interlocking buttons mounted in one said extended peripheral edge opposite said hinge, opposing raised buttons insertably removable from said interlocking buttons mounted in the other said extended peripheral edge opposite said hinge, a channel seal for said shaft defining a right angle channel extending from said end surface to said peripheral edge opposite said hinge, and a plurality of tabs mounted on a portion of said peripheral edges opposite said hinge with at least the first tab offset at least the second tab providing opposing handles for the user to disengage said perimeter seal means, whereby, for the condition of said cylinder portions being hingedly open, the user may removably insert said roller cover with said roller applicator shaft within said channel seal into said protective housing and enclose said roller cover with said protective housing by engaging said perimeter seal means.

* * * * *